United States Patent [19]

Guth

[11] Patent Number: 5,067,908

[45] Date of Patent: Nov. 26, 1991

[54] SELF-ALIGNING CONNECTOR

[75] Inventor: Lloyd A. Guth, San Diego, Calif.

[73] Assignee: General Dynamics Corporation, Convair Division, San Diego, Calif.

[21] Appl. No.: 615,521

[22] Filed: Nov. 19, 1990

[51] Int. Cl.[5] ..... H01R 13/629

[52] U.S. Cl. ..... 439/248; 439/564

[58] Field of Search ..... 439/248, 246, 247, 249–252, 439/563, 564, 570, 573

*Primary Examiner*—Gary F. Paumen

*Attorney, Agent, or Firm*—John R. Duncan; Frank D. Gilliam

[57] ABSTRACT

A self-aligning connector that is used with electrical plug-in-module connectors. The self-aligning connector has an elongated connector body with a cutout portion extending from its top surface to its bottom surface to form a walled structure that would surround an electrical contact area. A foot portion extends from each end of the connector body. Each foot portion has an inclined front surface that mates with the inclined bottom wedge surface of a wedge block. Elongated slots in the respective wedge blocks algin with vertically oriented bore holes in the foot portions and mounting screws are passed downwardly through the respective openings. As the mounting screws are tightened the wedge blocks and foot portions have relative translation along their inclined surfaces, thus aligning the connector in the cutout portion.

5 Claims, 2 Drawing Sheets

SELF-ALIGNING CONNECTOR

BACKGROUND OF THE INVENTION

The present invention relates to connectors and more specifically to a self-aligning connector to be used with plug-in electrical module connectors.

Presently there is a problem which occurs when misaligned connector contacts are forced to mate together. Often there are damaging forces that occur during the mating operation. These forces, which are perpendicular to the longitudinal axis of the mating connector contacts, can cause a variety of anomalities. Some examples of these include: (1) excessive deflection of mated contacts which can result in contact breakage, (2) inability to mate the connectors unless expensive tooling and time consuming assembly procedures are used to prealign the connectors during their installation, (3) uneven/non-symmetrical contact intermating normal forces which can cause unpredictable conductivity characteristics, (4) excessive wear of the finishes on the mating surfaces of the contacts, (5) substandard physical interfacing of the plug-in-module with the system chassis, which will impair thermal transfer characteristics, vibration performance, etc. of the plug-in-module. These problems are common when plug-in-modules are blind mated with backplane connectors.

The misregistration, previously mentioned, is essentially the result of two principal tolerances. One tolerance occurs among the individual contacts within the contact patterns of the two connectors. This is a small and generally inconsequential tolerance relative to the second tolerance which is that of the location of the backplane connector relative to the location of the plug-in-module's connector.

It is an object of the invention to provide a novel self-aligning connector such that when it is installed in a system chassis, it physically self-aligns or registers itself automatically relative to the exact same datum (surface) that the plug-in-module does when it is installed.

It is also an object of the invention to provide a novel self-aligned connector that is economical to manufacture and market.

It is another object of the invention to provide a novel self-aligning connector that is easily installed in a system chassis.

SUMMARY OF THE INVENTION

Applicant's novel self-aligning connector has been designed to eliminate the problems of the past when plug-in-modules are blind mated with backplane connectors. The solution to the problem has been to design the backplane's connectors such that when it is installed in the system, it physically self-aligns or registers itself automatically relative to the exact same datum (surface) that the plug-in-module does when it is installed.

Rather than having conventional mounting holes, as do traditional connectors, applicant's connector has a pair of movable wedge blocks, a pair of foot portions having inclined front surfaces and a registering datum surface at each end of the connector body. When the connector is installed and fastened in place using common mounting screws, the wedge blocks slide down along their respective inclined surfaces, forcing the body of the connector to move laterally and seat against (reference off of) the very same datum surface which the plug-in-module does when it is subsequently installed, thus drastically reducing or eliminating the gross misalignment which would otherwise occur.

DESCRIPTION OF THE PREFERRED EMBODIMENT

Applicant's novel self-aligning connector will now be described by referring to FIGS. 1–4 of the drawings. A self-aligning connector is generally designated numeral 10.

Figure 1:
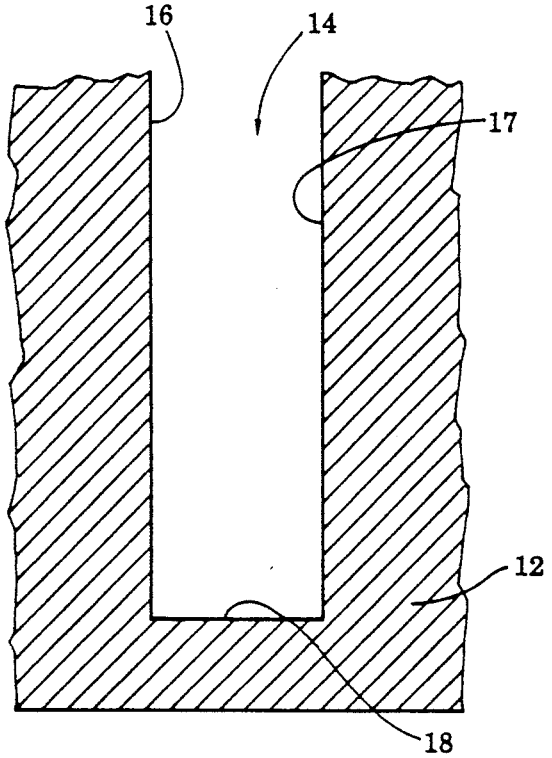
FIG. 1 is a cross sectional view of a connector mounting channel formed in a system chassis.
Figure 1A:
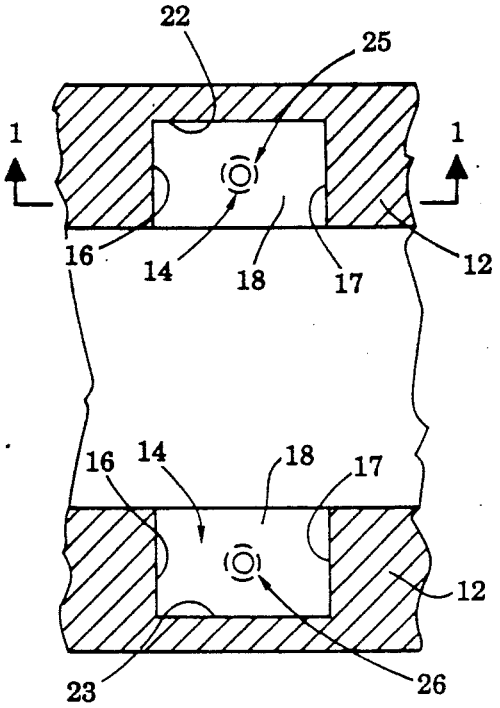
FIG. 1A is a top plan view of the channel of FIG. 1.
Figure 2:
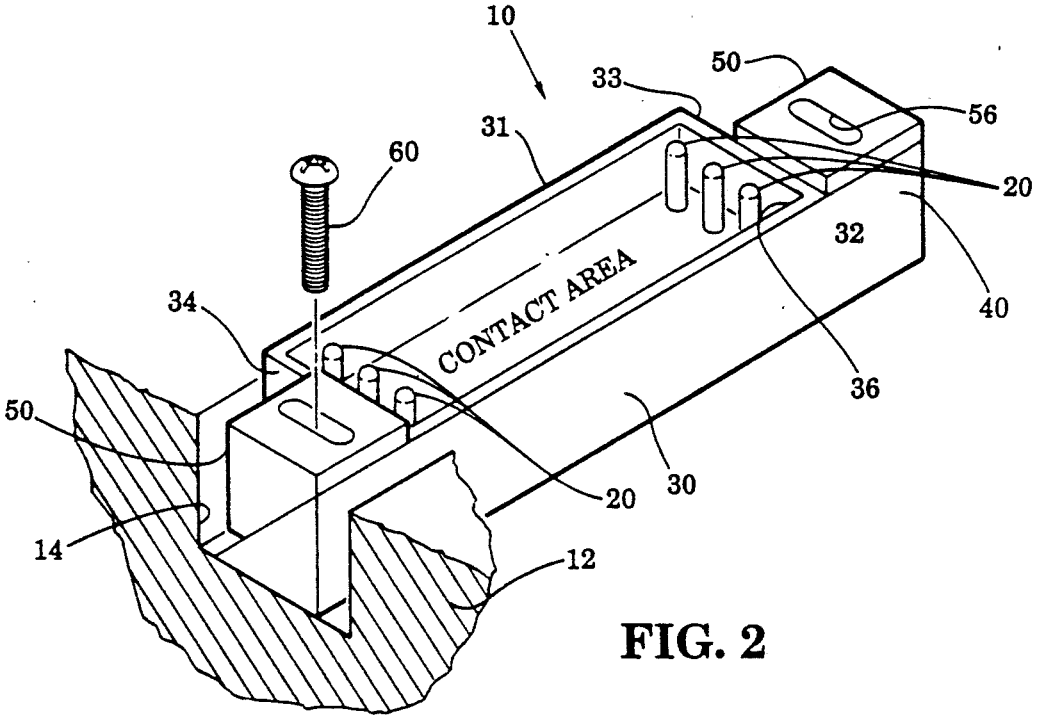
FIG. 2 is a front perspective view illustrating the self-aligning connector installed in the system chassis.
Figure 3:
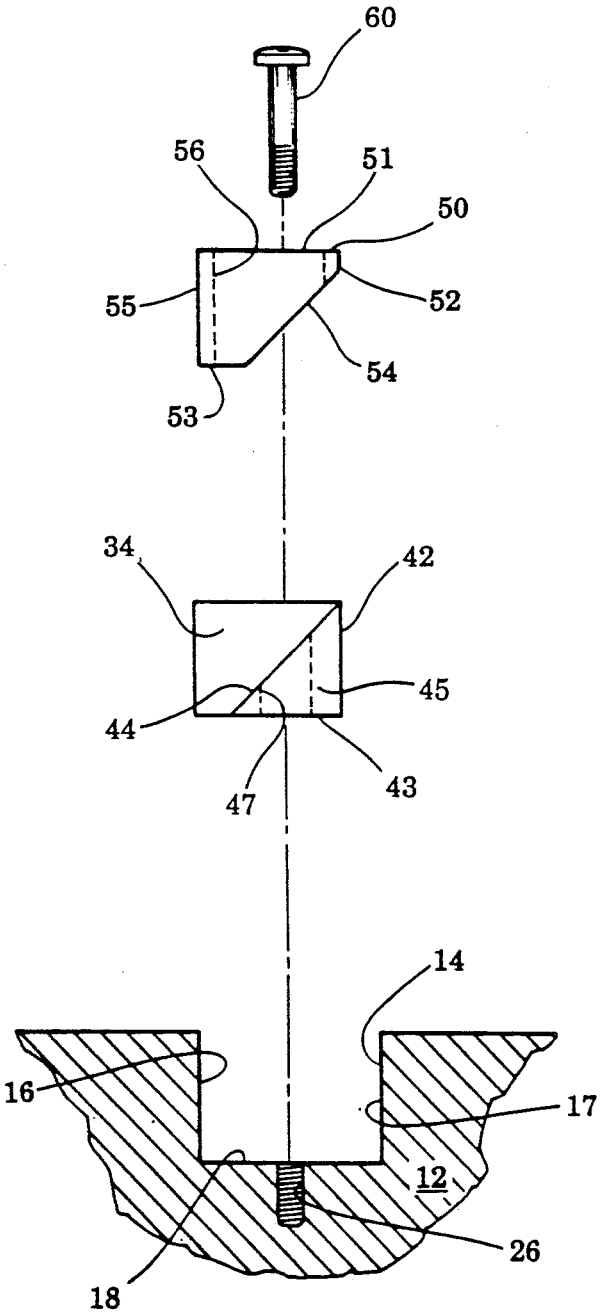
FIG. 3 is an exploded side elevation view of the components of the self-aligning connector and the groove in the system chassis.
Figure 5:
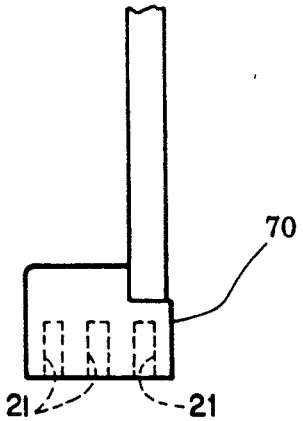
FIG. 5 is a side elevation view of a portion of a plug-in-module that would be used with the above-mentioned self-aligning connector.

In FIG. 1 the structure illustrates how the self-aligning connector 10 is used. It illustrates the system chassis 12 having a channel 14 therein. Channel 14 has a front lateral wall surface 16, a rear lateral surface 17 and a bottom wall surface 18. Mating connector male contacts 20 extend upwardly from the mating connector 10 to engage with mating socket contacts 21 on a plug-in electrical module 70, see FIG. 5. Channel 14 also has end walls 22 and 23 and threaded tap holes 25 and 26. Self-aligning connector 10 has a connector body 30 having a front wall 31, a rear wall 32, and end walls 33 and 34. A cutout portion 36 extends from the top surface of connector body 30 through to its bottom surface.

A pair of foot portions 40 extend longitudinally from the respective end walls 33 and 34. Each of these foot portions 40 have a rear wall 42, a horizontally oriented bottom wall 43 and an inclined front surface 44. They each have an end wall surface 45. A horizontally bore hole 47 extends downwardly through each of the foot portions 40.

A pair of wedge blocks 50 each have a top wall surface 51, a rear wall surface 52, a bottom wall surface 53, an inclined bottom surface 54 and a front wall surface 55. A slot 56 extends from the top wall surface through to the bottom wall surface of wedge blocks 50.

Figure 4:
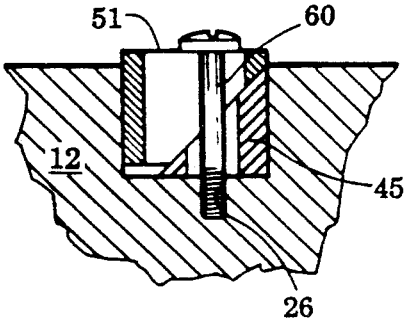
FIG. 4 is a cross sectional elevation view showing the self-aligning connector tightened down in the groove of the system chassis.

Mounting screws 60 are inserted downwardly through slots 56 and elongated bore holes 47 into threaded tap holes 26. As the mounting screws are tightened down surface 54 translates along surface 44 as slot 56 translates relative to screw 60, whereby rear walls 42 of the foot portions are forced horizontally into contact with the rear wall 17 of groove 14. At the same time, front wall surface 55 of the wedge blocks 50 is transmitted horizontally into wedged contact with front wall 16 of groove 14. This final position is illustrated in FIG. 4 and when so positioned insures the proper alignment for the mating electrical contacts 20 and the plug-in module 70 FIG. 5.

What is claimed:

1. A self-aligning connector comprising:

an elongated connector body having a predetermined length, a top surface, a horizontally oriented bottom surface, a front wall, a vertically orientated rear wall and laterally spaced end walls;

a cutout portion of said connector body enclosing electrical contacts, said cutout portion extending between said top and bottom surfaces;

a foot portion extending longitudinally from each of the end walls of said connector body each of said foot portions having an end wall surface, a horizontally orientated bottom surface, a vertically orientated rear wall, and an inclined front wall having an acute angle, a vertically oriented elongated horizontally bore hole extends from said inclined front wall to said bottom surface; and a wedge block detachably connected to each of said foot portions, each of said wedge blocks having a top surface and an inclined bottom wedge surface that mates with the inclined front wall of a respective said foot portion, an elongated slot extending through each of said wedge blocks from their top surface to their inclined bottom wedge surface.

2. A self-aligning connector as recited in claim 1 further comprising a pair of mounting screws that are inserted into the respective slots of said wedge blocks and then into the respective vertically oriented horizontally elongated bore holes of said foot portions.

3. A self-aligning connector as recited in claim 1 wherein the cutout portion in said connector body is four sided.

4. A self-aligning connector as recited in claim 3 wherein said cutout portion has a rectangular configuration.

5. A self-aligning connector as recited in claim 1 in combination with a system chassis having a wall surface with at least one elongated channel formed therein said electrical connector contacts extending upwardly therein, said connector body being inserted into said at least one elongated channel along with said respective wedge blocks and being secured to said channel.

* * * * *